United States Patent [19]

Wiltse

[11] Patent Number: 4,981,397

[45] Date of Patent: Jan. 1, 1991

[54] LIGHTWEIGHT SECTIONAL DOCK SYSTEM

[75] Inventor: Lee B. Wiltse, Roscommon, Mich.

[73] Assignee: North Central Welding, Inc., Roscommon, Mich.

[21] Appl. No.: 551,073

[22] Filed: Jul. 11, 1990

[51] Int. Cl.[5] ..... E02B 3/20

[52] U.S. Cl. ..... 405/218; 182/179

[58] Field of Search ..... 405/218–221, 405/196; 182/145; 248/423

[56] References Cited

U.S. PATENT DOCUMENTS

| | | | |
|---|---|---|---|
| 1,060,914 | 5/1913 | Lillow | 182/179 |
| 3,245,495 | 4/1966 | Wells | 182/179 |
| 4,212,564 | 7/1980 | Kay | 405/128 |

*Primary Examiner*—Dennis L. Taylor

*Attorney, Agent, or Firm*—Learman & McCulloch

[57] ABSTRACT

A readily erectable and demountable lightweight sectional dock structure has cylindrical anchor posts arranged in a series of spaced pairs, stringers supporting deck plates, and cross braces. Clamp structures unite the stringers and cross braces independently to the posts and comprise a first U-shaped outer part with a semi-cylindrical post socket joined to leg portions having flat, interior, transversely extending, interlock surface portions removably joined to an inner clamp part with an opposing socket forming a merged continuation of the first part socket, the inner clamp part having longitudinally spaced, transversely extending socket legs with flat transversely extending exterior interlock surface portions abutting the interior surface portions on the outer clamp part, and transversely inwardly extending projections on the inner clamp parts receiving the cross braces telescopically.

10 Claims, 2 Drawing Sheets

LIGHTWEIGHT SECTIONAL DOCK SYSTEM

BACKGROUND OF THE INVENTION

The dock system of the present invention is of portable lightweight construction and employs multi-purpose clamp structures which cooperate with sectional stringers and cross brace elements in a manner to rigidly fix the dock to the standards or anchor posts which extend vertically below the water line to support the system on the bed of a lake or other body of water. More particularly the invention is concerned with a dock construction, utilizing readily available or extrudable aluminum members, which can be easily erected and demounted seasonally with relatively little effort. A variety of prior patents have been granted for various dock structures including the following:

| | |
|---|---|
| Re. 24,837 | Usab |
| 2,044,703 | Kline |
| 3,287,919 | Hahn |
| 3,345,825 | Parker |
| 3,614,871 | Nordell |
| 3,999,397 | Albery |
| 4,028,899 | Carmichael, III |
| 4,037,420 | Wicks |
| 4,050,257 | Parks et al |
| 4,087,977 | Kuhlman |

While these patents incorporate some of the elements of the invention claimed, it is to be noted that none of them combinatively disclose the claimed invention. For example, while the Usab patent Re. No. 24,837 discloses a two part clamp, it lacks the complementing, abutting, flat interlock surfaces which are utilized by the applicant, and other elements which are defined. The Parks et al Pat. No. 4,050,257 discloses cross braces which telescopically receive projections on the clamp structure but lacks other elements of the combination claimed.

SUMMARY OF THE INVENTION

The present invention incorporates clamp structures providing interlocking bearing engagement between transverse flat surfaces on two part clamps for cylindrical standards or anchor posts. The invention further provides a unique clamping relationship with deck supporting stringer members and cross brace or tie members in a manner to combat forces tending to dismember the dock and provide a readily disassemblable, yet rigid, dock system of portable, light weight construction which can be readily stored.

One of the prime objects of the present invention is to provide an improved modular dock system which is safe for the use of both children and adults, and can be economically constructed of non-rusting, lightweight structural members which are either available or readily extrudable.

Still another object of the invention is to provide a system of the character described which has great strength, and yet can be readily disassembled for storage during the winter, and also readily disassembled and reassembled to adjust to changing water levels when necessary.

Another object of the invention is to provide a dock which is water and weather resistant, and when erected, is rigid and durable, with the interacting stringers and cross tie members all being directly tied independently to the clamp structure.

Other objects and advantages of the invention will be pointed out specifically or will become apparent from the following description when it is considered in conjunction with the appended claims and the accompanying drawings.

DESCRIPTION OF THE DRAWINGS

For a more detailed description of the present invention, attention is directed to the more detailed description which follows, taken in conjunction with the following drawings wherein.

Figure 1:
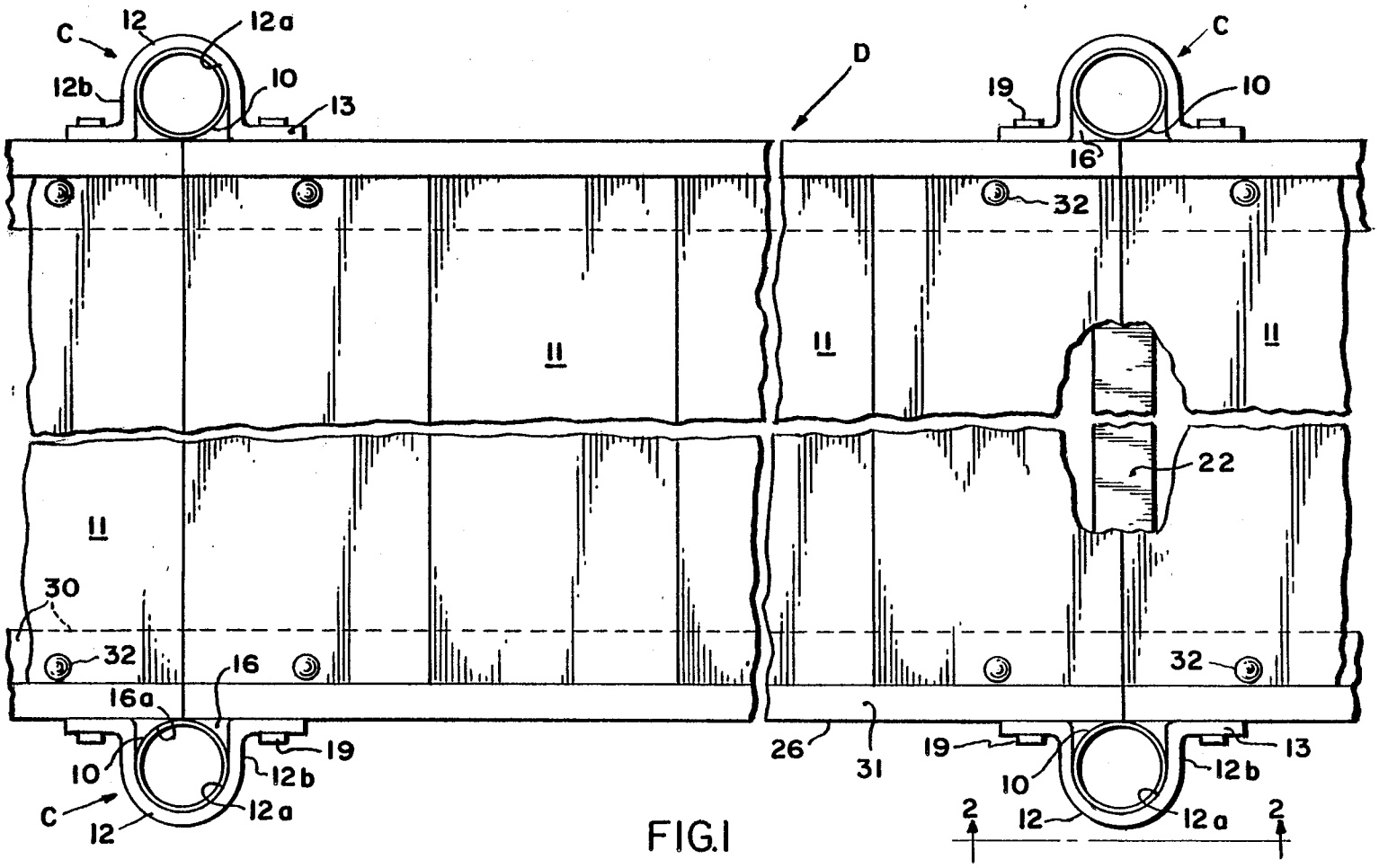
FIG. 1 is a fragmentary, top plan view of the dock system.

Referring now more particularly to the accompanying drawings, a dock structure, generally designated D, is shown as comprising longitudinally spaced pairs of anchor standards or posts 10 of tubular cylindrical configuration, which have appropriate spike or plate bases, dependent upon whether the dock is to be supported on sandy or rocky water beds. Alternatively, depending upon the degree of disassembly desired, the anchor posts 10 might be secured in suitable cement footings. It is anticipated that the dock system will be constructed entirely of aluminum, except for the longitudinally abutting deck plates 11 which may be of wood construction, as shown in the drawings.

Figure 4:
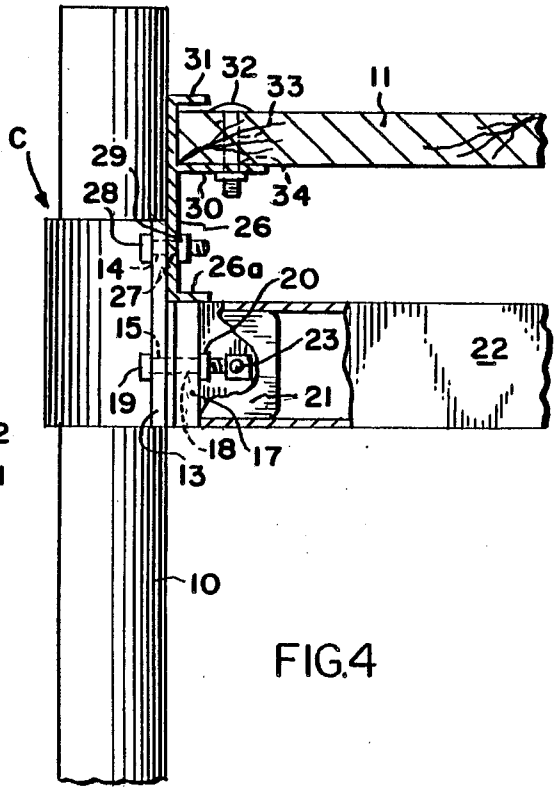
FIG. 4 is a fragmentary and partly sectional, elevational view, taken on the line 4—4 of FIG. 2.
Figure 3:
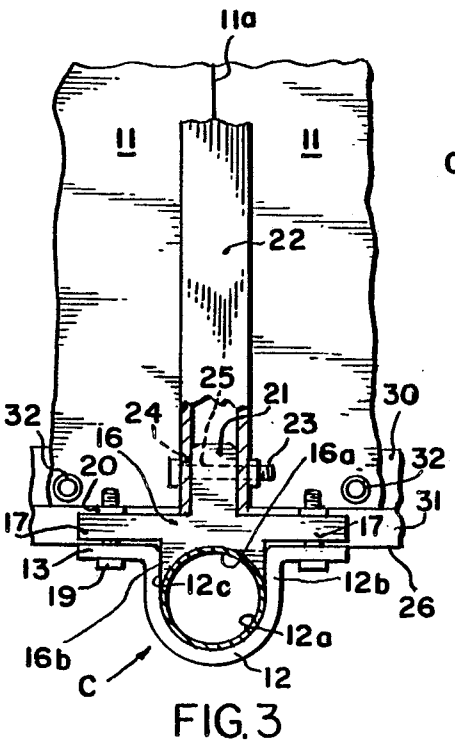
FIG. 3 is a fragmentary, sectional, inverse plan view, taken on the line 3—3 of FIG. 2.

Provided to support the deck plates 11 at a predetermined level via posts 10 are clamp structures of unique and improved construction generally designated C, which rigidly clamp to the standards 10 and prevent any tendency of the dock elements to slide vertically on the anchor posts 10, while at the same time restraining any tendency of the dock elements to twist under, for example, rough water or wind stresses. Each of the clamp structures C includes an outer clamp member 12 of generally U-shape which comprises an outer semi-cylindrical, socket forming portion **12*a* for snugly enveloping the post 10, and leg sections 12*b* which are linear and rectangular in section, and have flat interlock interior bearing faces 12*c*. Each outer clamp member 12 further has longitudinally extending flanges 13, with upper bolt openings 14 and lower bolt openings 15. An inner clamp 16 for each clamp C has a partly 10 cylindrical, opposing socket portion 16*a* snugly receiving the pipe 10. The portion 16*a* is rectangular in section to provide flat interlock exterior bearing walls 16*b* at each side, which abut and have sliding bearing engagement with the surfaces 12*c*. As FIGS. 3 and 4 indicate the inner clamp members 16 have flange portions 17 which are co-extensive with the flanges 13 but are of reduced height with respect thereto. Openings 18 are provided in the flanges 17 in alignment with the lower openings 15 in flanges 13 to accommodate the clamp bolts 19 which extend through openings 15 and 18 and are secured by nuts 20. The flanges 13 and 17** remain slightly spaced in the bolted condition.

Figure 2:
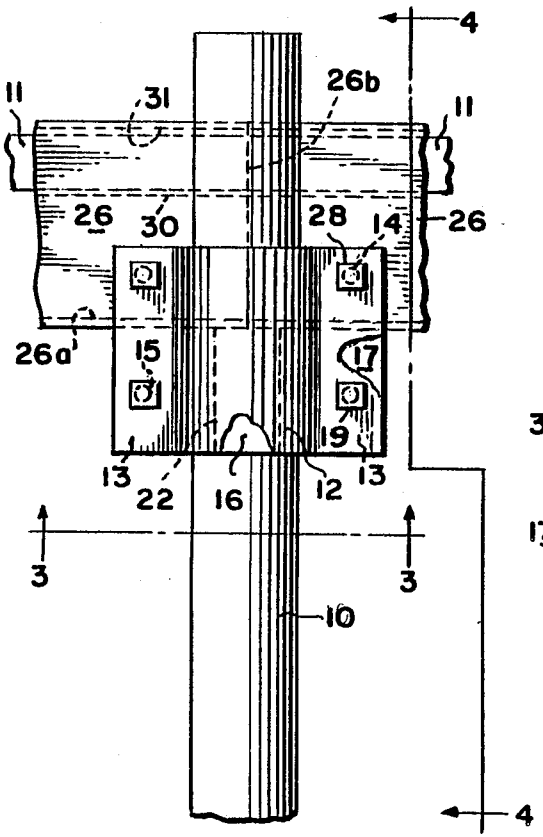
FIG. 2 is a fragmentary, side elevational view, taken on the line 2—2 of FIG. 1.

The inner clamp plates 16 also have transversely projecting projections 21 of rectangular section which are configured to be snugly received in rectangular tubes 22 which extend transversely across the deck system to also snugly receive the projections 21 on the opposite clamp structures C in the same manner. Bolts 23 extend through openings 24 in the members 22, and 25 in the projections 21, to fix the projections 21 in telescoped position. Resting on, and supported by the clamp plates 13 and cross ties 22, are longitudinally extending stringers 26, having flanges 26a for this purpose. The stringers 26 have openings 27 (FIG. 4) in alignment with the openings 14 in outer clamp flanges 13 for receiving clamp bolts 28 which are secured by nuts 29. The upper portions of stringers 26, which may typically be 10 feet in length, and are clamped in longitudinally abutting relationship to anchor posts 10, have shelf portions 30 and upper overlying flanges 31 providing tracks for receiving the deck plates 11. Fastener bolts 32, extend through openings 33 provided in appropriate end deck plates 11, and 34 provided in the shelf portions 30, to accommodate the bolts 32. As FIG. 2 indicates, the stringers 26 are sectional, and the ends meet as at 26b intermediate the sockets created by inner and outer clamps 16 and 12 respectively. The deck sections 11 abut similarly at 11a to form the deck of the dockway or pathway which the structure provides.

Preferably the dock is thus formed of modules which can be readily disassembled and stored, and then readily re-erected when desired. The erection of the dock system can be accomplished in a number of sequences, once posts 10 are in place. For example, clamp structures C can be loosely assembled on transversely aligned posts 10 in a manner such that the projections 21 are received within the cross ties 22. With bolts 19 and 23 tightened down, the stringers 26 can be secured by tightening down the bolts 28 to rigidify the rectangularly configured structure. Finally, deck plates 11 can be placed in position and secured by tightening down appropriate bolts 32. The interlocked bearing surfaces 12c and 16b prevent any relative twisting of the clamp parts 12 and 16, and any tendency of the stringers 26 to twist is prevented by bearing engagement between the lower flanged ends 26a of stringers 26 and the clamped engagement with flanges 13, considered in combination with the snug engagement of projections 21 telescoped within tie members 22. The upper ends of posts 10 can, of course, be capped in the usual manner.

Although preferred embodiments of the invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention which is defined in the following claims.

What I claim is:

1. A readily erectable and strikeable, lightweight sectional dock structure comprising:

a. a plurality of transversely spaced, cylindrical vertical standards arranged in longitudinally spaced pairs to provide an elongate array;

b. longitudinally extending, transversely spaced, stringers disposed inwardly of said standards in abutting relationship therewith to define a dock length;

c. said stringers including an inwardly extending deck-supporting upper shelf portion and a lower portion;

d. deck plates on the upper shelf portions of transversely spaced stringers spanning the upper shelf portions to provide a walkway;

e. a series of transversely disposed cross braces;

f. clamp structures for said standards, each having a first U-shaped outer clamp part with a semi-cylindrical socket portion enveloping the outer portion of the standard joined to leg portions having flat, transversely extending, interior interlock surface portions and longitudinally extending flanges removably secured to the lower portions of said stringers, said clamp structures also each having an inner, opposing clamp part with a partly cylindrical, opposing socket portion forming a merged continuation of said first part socket, the inner clamp parts having longitudinally spaced, transversely extending socket legs with flat transversely extending, exterior, interlock surface portions received by and abutting said interlock surface portions on the outer clamp parts;

g. mating, longitudinally extending flanges on said inner clamp parts extending longitudinally coextensively with the flanges on the outer clamp parts, and having releaseable clamping fastener means extending to the flanges on the outer clamp parts to tightly clamp to the standards; and h. transversely inwardly extending projections integrated with said inner clamp parts opposite said socket portions receiving said cross braces telescopically, and having fastener means for removably securing said cross braces to said clamp structures.

2. The dock structure of claim 1 wherein said stringers have transversely inwardly extending flange portions on their lower portions resting on said inner clamp parts.

3. The dock structure of claim 1 wherein said upper portions of the stringers have flange portions spaced above said shelf portions to overlie said shelf portions, and fastener means removably secures appropriate deck plates to said shelf portions.

4. The dock structure of claim 1 wherein said stringers are of a length to longitudinally abut at said clamp structures so that the flanges of each clamp structure overlie and clamp to a pair of stringers.

5. The dock structure of claim 1 wherein the flanges on said outer clamp parts have upper portions which extend above said flanges on the inner clamp parts, and removably secure to said stringers via fastener means extending between said lower portions of the stringers and the flanges on the outer clamp parts.

6. The dock structure of claim 1 wherein said cross braces are of tubular rectangular configuration with flat internal wall surfaces, and said clamp structure projections are shaped to be snugly received within said cross braces with flat surfaces received by the flat internal wall surfaces of said cross braces to prevent relative torsional twisting.

7. A method of erecting dock sections supported by a plurality of transversely spaced, vertical, cylindrical anchor posts arranged in longitudinally spaced pairs comprising longitudinally extending transversely spaced stringers disposed inwardly of the posts in abutting relationship therewith to define a dock length, the stringers including an inwardly extending upper deck supporting shelf portion and a lower portion, a series of deck plates spanning the upper shelf portions of transversely opposite stringers to provide a walkway, a series of transversely disposed cross braces extending between the posts, clamp structure for the standards, each having a first U-shaped outer clamp part with a hemi-cylindrical socket portion enveloping the outer portion of a post joined to leg portions having flat transversely extending interior interlock surface portions and longitudinally extending flanges removably secured to the lower portions of the stringers, the clamp structures also each having an inner clamp part with a partly cylindrical opposing socket portion forming a merged continuation of the first clamp part socket, the inner clamp parts each having longitudinally spaced transversely extending socket legs with flat, transversely extending, exterior interlock surface portions received by and abutting the interlock surface portions on the outer clamp parts, mating longitudinally extending flanges on the inner clamp parts extending longitudinally coextensively with the flanges on the outer clamp part and having releaseable clamping fastener means extending to the flanges on the outer clamp part to tightly clamp the clamp structures to the posts, and transversely inwardly extending projections on the inner clamp parts opposite the socket portions receiving the cross braces telescopically and having fastener means for removably securing the cross braces to the clamp structure, the steps of:

a. arranging the inner and outer clamp parts of the clamp structures in post-enveloping relation on the posts at a predetermined level below the upper ends thereof and with the flat interlock surfaces of the outer and inner clamp parts in abutting relation, and the inner clamp plate projections telescopically received by the cross braces, and with flanges of the outer clamp parts lying adjacent stringers arranged in abutting relation with the posts;

b. securing fasteners clamping the inner and outer clamp parts of each clamp structure to the posts, the outer clamp plates to the stringers, and the stringers to the outer clamp parts; and c. securing deck plates on the stringer shelves to provide a dock walkway.

8. A clamp structure for a lightweight portable demountable dock system comprising a plurality of transversely spaced vertical, cylindrical anchor posts arranged in longitudinally spaced pairs, longitudinally extending transversely spaced stringers disposed inwardly of said posts in abutting relationship therewith to define a dock length, said stringers including inwardly extending upper dock deck supporting shelf portions and lower portions, a series of longitudinally abutting deck plates on the upper shelf portions of the transversely spaced stringers to provide a walkway, and transversely disposed cross braces extending between transversely spaced clamp structures, comprising:

a. a first U-shaped outer part with a hemi-cylindrical socket portion enveloping the outer portion of the post joined to leg portions having flat tranversely extending, interior, interlock surface portions and longitudinally extending flanges for removably securing to the lower portions of the stringers, said clamp structures also each having an inner clamp part with a partly cylindrical, opposing socket portion forming a merged continuation of said first clamp part socket, the inner clamp parts having longitudinally spaced transversely extending socket legs with flat, transversely extending, exterior, interlock surface portions received by and abutting said interlock surfaces portions on the outer clamp part.

b. mating longitudinally extending flanges on each inner clamp part extending coextensively with the flanges on the outer clamp part and having releasable clamping fastener means extending to the flanges on the outer clamp part to tightly clamp the inner and outer clamp parts to the posts, and c. transversely inwardly extending projections on the inner clamp parts opposite the socket portions for receiving the cross braces telescopically and having fastener means for removably securing the cross braces to the clamp structures.

9. The structure of claim 8 wherein the flanges on the outer clamp parts have upper portions which extend above the flanges on the inner clamp parts to removably secure to the stringers via fastener means extending between the upper portions of the stringers and the outer clamp parts.

10. The structure of claim 8 wherein the inner clamp part projections are of rectangular shape to be snugly received within tubular cross braces of like rectangular shape to provide flat surfaces received by the flat internal wall surfaces of the cross braces and prevent rotatable tortional twisting.

* * * * *